US006457602B2

(12) United States Patent
Uchiyama

(10) Patent No.: US 6,457,602 B2
(45) **Date of Patent: *Oct. 1, 2002**

(54) PLASTIC CONTAINER, AND METHOD OF AND DEVICE FOR SUPPLYING PHOTOGRAPHIC PROCESSING CHEMICALS USING THE PLASTIC CONTAINER

(75) Inventor: Kimiyoshi Uchiyama, Kanagawa (JP)

(73) Assignee: Fuji Photo Film Co., Ltd., Minami-Ashigara (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/265,385

(22) Filed: Mar. 10, 1999

(30) Foreign Application Priority Data

Mar. 31, 1998 (JP) ..... 10-087747

(51) Int. Cl.[7] ..... B65D 1/40
(52) U.S. Cl. ..... 220/669; 220/675; 215/382
(58) Field of Search ..... 220/669, 675; 215/382, 379, 40

(56) References Cited

U.S. PATENT DOCUMENTS

| | | | | | |
|---|---|---|---|---|---|
| D135,998 | S | * | 7/1943 | Schneier | 215/40 X |
| 3,212,661 | A | * | 10/1965 | Adell | 215/382 X |
| 3,325,031 | A | * | 6/1967 | Singier | 215/382 X |
| 5,123,554 | A | * | 6/1992 | Arvidson et al. | 215/382 X |
| 5,435,451 | A | * | 7/1995 | Dyer | 220/675 X |
| 5,499,730 | A | * | 3/1996 | Harbour | 220/675 X |

FOREIGN PATENT DOCUMENTS

| | | |
|---|---|---|
| EP | 0 469 777 A2 | 2/1992 |
| EP | 0 590 782 A1 | 4/1994 |
| EP | 0 717 316 A1 | 6/1996 |
| WO | WO 94/25350 | 11/1994 |

OTHER PUBLICATIONS

Patent Abstracts of Japan, vol. 098, No. 012, Oct. 31, 1998, Japanese Patent Publication No. 10–197999, Publication Date Jul. 31, 1998, Abstract.

patent Abstracts of Japan. vol. 097, No. 009, Sep. 30, 1997, Japanese Patent Publication No. 09–138495, Publication Date May 27, 1997, Abstract.

* cited by examiner

*Primary Examiner*—Steven Pollard
(74) *Attorney, Agent, or Firm*—Burns, Doane, Swecker & Mathis, LLP

(57) ABSTRACT

A plastic container comprising a bottom portion which has a substantially rectangular bottom surface, a trunk portion which is formed by four planes which rise up vertically from respective sides of the bottom surface and which is substantially rectangular pipe-shaped, a mouth portion whose surface area of a portion surrounded by a horizontal cross section is smaller than the surface area of the trunk portion, and a shoulder portion which is narrowed down from the trunk portion to the mouth portion, characterized in that: the amount of the contents of the plastic container is 800 to 3000 ml; the average thickness of the trunk portion is 0.2 to 0.7 mm; the ratio of a length H of the trunk portion to a length L of a diagonal line of a rectangle formed by the outer periphery of a horizontal cross section of the trunk portion (H/L) is 2 to 4; and each of the vertexes of the rectangle formed by the outer periphery of the horizontal cross section of the trunk portion forms an arc-shaped configuration so that a radius R of curvature of the vertex is 3 to 20 mm. The plastic container has a high space efficiency, has self-sustainability and configuration maintainability, is friendly to the environment in that it is easy for the container to be crushed, and is useful as a container for photographic processing chemicals. A method of and a device for supplying photographic processing chemicals using this plastic container is also provided.

24 Claims, 7 Drawing Sheets

PLASTIC CONTAINER, AND METHOD OF AND DEVICE FOR SUPPLYING PHOTOGRAPHIC PROCESSING CHEMICALS USING THE PLASTIC CONTAINER

BACKGROUND OF THE INVENTION

1. Field of the Invention

The present invention relates to a plastic container having a so-called bottle-shaped configuration and, in particular, to a plastic container whose space is used efficiency, has self-sustainability and configuration maintainability, and is friendly to the environment in that it is easy for the container to be crushed. Further, the present invention relates to a plastic container which has excellent chemical resistance and dimensional accuracy and is especially useful as a container for photographic processing chemicals.

Further, the present invention relates to a method of and a device for supplying photographic processing chemicals using the plastic container having these characteristics.

2. Description of the Related Art

Conventionally, a plastic container is used as a container for keeping chemicals, food, or the like from the viewpoints of weight reduction, impact resistance, chemical resistance, or the like.

Because a material of the plastic container is flexible, the thickness of the container is increased to some extent so as to maintain the strength thereof. Due to this strengthening, it is difficult for the plastic container to be crushed and, when the plastic container is used and disposed of thereafter (In the present invention, the concept of "disposal" includes a case in which the plastic container is temporarily collected, stored, or the like for recycling.), there is a drawback in that the plastic container is bulky due to the existence of a wasteful volume of a hollow portion.

If the plastic container is made too thin in consideration of the easiness of crushing at the time of disposal, self-sustainability and configuration maintainability of the entire container are lowered.

In particular, when a container having a certain amount of height is used for its original purpose, i.e., to contain a content such as a liquid or the like, the lower portion of the container expands and the container becomes unstable so that it falls down from a simple impact.

Further, when a lid, a seal portion, or the like is opened as occasion demands in order to remove the contents from the plastic container and then the plastic container is turned upside down, there is a case in which internal pressure of the container is lowered due to the outflow of the liquid or the like, the plastic container is crushed, and thereby the configuration thereof is deformed. Because of this configuration deformation, it is less convenient to wash or carry out other treatments on the container thereafter, and there is a drawback in that the container cannot be reused.

On the other hand, it has been desired by various industries that the volume of the container, e.g., the volume of a container for photographic processing chemicals which supplies photographic processing chemicals, be increased. (In the present invention, "container for photographic processing chemicals" refers to a container used for the purpose of containing photographic processing chemicals.) From the viewpoint of space efficiency, the increase in volume is preferably effected by making the surface area of a bottom surface of the container as small as possible and increasing the height thereof, i.e., by forming an elongated container.

In order to make the elongated plastic container as thin as possible and secure self-sustainability and configuration maintainability, first, the configuration of the entire container should be cylindrical. When the container is cylindrical and contains contents such as a liquid, a force is not concentrated on one point of the side surface of the container and can be supported by the entire side surface thereof. Thus, it is preferable from the point of securing self-sustainability.

However, when, for example, the cylindrical plastic containers are packed in a case, there are large dead spaces between the containers such that the space efficiency is extremely poor. Moreover, since there is no vertex portion serving as a pillar on the side surface of the cylindrical plastic container, configuration maintainability thereof easily lowers, i.e., it is easy for the container to be crushed due to a decrease in the internal pressure thereof when, for example, the contents flow out. Thus, the configuration of the container can be deformed.

If the entire container is simply rectangular pipe-shaped so as to improve space efficiency, when the container is filled with contents such as a liquid, a force is concentrated on the particular portions of side surfaces of the container. Accordingly, it is easy for the entire container to be twisted and self-sustainability and configuration maintainability of the container are low.

In order to reinforce the rectangular pipe-shaped container against twisting, a slit-shaped thick portion, i.e., a so-called rib, may be provided on the planar portion of each of the side surfaces of the container. However, contrary to the original request for thinning, disposability of the container is reduced in the end. Further, when the ribs are provided inside the container, washability of the inner portion of the container is lowered at the time of disposal, and when the ribs are provided outside the container, the space efficiency is lowered due to projection of the ribs.

Consequently, a configuration of the elongated plastic container which satisfies all of the following characteristics, i.e., reducing the thickness, having self-sustainability and configuration maintainability, and having high space efficiency, is not yet obtained.

The above-described requests for the plastic container are especially strong for the container for photographic processing chemicals which supplies photographic processing chemicals to an automatic processor such as a film processor, a printer processor, or the like. The desirable plastic container is elongated, has a certain amount of volume, has high space efficiency, has self-sustainability and configuration maintainability, and is friendly to the environment so that it is easy for the container to be crushed. Further, the container for photographic processing chemicals has to be chemical resistant since the liquid to be contained therein, e.g., a development processing solution, is a strong alkali or the like. Moreover, the dimensions of the container which is loaded onto the automatic processor for supplying the photographic processing chemicals have to be accurate.

SUMMARY OF THE INVENTION

With the aforementioned in view, an object of the present invention is to provide a plastic container which has a certain amount of volume, has high space efficiency, has self-sustainability and configuration maintainability, and is friendly to the environment so that it is easy for the container to be crushed.

Further, another purpose of the present invention is to provide a plastic container which has excellent chemical resistance and dimensional accuracy, and which is particularly useful as a container for photographic processing chemicals.

Moreover, an object of the present invention is to provide a method of and a device for supplying photographic processing chemicals using the plastic container having these characteristics.

The above-described objects are achieved in accordance with the following aspects.

Namely, a first aspect of the present invention is a plastic container comprising a bottom portion which has a substantially rectangular bottom surface, a trunk portion which is formed by four planes which rise up vertically from respective sides of the bottom surface and which is substantially rectangular pipe-shaped, a mouth portion whose cross-sectional area of a portion surrounded by a horizontal cross section is smaller than the horizontal cross-sectional area of the trunk portion, and a shoulder portion which is narrowed down from the trunk portion to the mouth portion, wherein: the amount of the contents of the plastic container is 800 to 3000 ml; the average thickness of the trunk portion is 0.2 to 0.7 mm; the ratio of a length H of the trunk portion to a length L of a diagonal line of a rectangle formed by the outer periphery of a horizontal cross section of the trunk portion (H/L) is 2 to 4; and each of vertexes of the rectangle formed by the outer periphery of the horizontal cross section of the trunk portion forms an arc-shaped configuration so that a radius R of curvature of the vertex is 3 to 20 mm.

The plastic container having a so-called bottle-shaped configuration is a plastic container having an elongated configuration, wherein: the amount of the contents is 800 to 3000 ml, and the ratio of the length H of the trunk portion to the length L of the diagonal line of the rectangle formed by the outer periphery of the horizontal cross section of the trunk portion (H/L) is 2 to 4. Since the trunk portion is substantially rectangular pipe-shaped, high space efficiency is obtained. Since the average thickness of the trunk portion is small, i.e., 0.2 to 0.7 mm, the plastic container is friendly to the environment so that the container can be easily crushed. Because each of the vertexes of the rectangle formed by the outer periphery of the horizontal cross section of the trunk portion is formed arc-shaped so that the radius R of curvature of the vertex is 3 to 20 mm, good self-sustainability and configuration maintainability can be obtained.

Namely, the structure of the above-described first aspect of the present invention forms a configuration of the elongated plastic container which balances and satisfies all of the following characteristics at high levels, i.e., thin, having self-sustainability and configuration maintainability, and having high space efficiency.

A second aspect of the present invention is a plastic container according to the first invention, wherein the plastic container is formed from HDPE (high density polyethylene) or LDPE (low density polyethylene).

By using the HDPE and the LDPE, the plastic container has high chemical resistance, has excellent impact resistance, and does not generate harmful gas even if the container is incinerated. Further, it is easy to recycle the container as a resource.

A third aspect of the present invention is a plastic container according to the first or second aspect, wherein the average thickness of the bottom portion is 0.8 to 5 mm.

Because the average thickness of the bottom portion is increased in this way, the self-sustainability of the container can be raised.

A fourth aspect of the present invention is a plastic container according to any one of the first through third aspects, wherein the plastic container is molded in accordance with an injection blow molding method.

In accordance with the injection blow molding method, it is easy to form the above-configured plastic container having excellent dimensional accuracy. Especially, it is easy to reduce the thickness of the trunk portion and increase the thickness of the portion other than the trunk portion.

A fifth aspect of the present invention is a plastic container comprising a bottom portion which has a substantially rectangular bottom surface, a trunk portion which is formed by four planes which rise up vertically from respective sides of the bottom surface and which is substantially rectangular pipe-shaped, a mouth portion whose cross-sectional area of a portion surrounded by a horizontal cross section is smaller than the horizontal cross-sectional area of the trunk portion, and a shoulder portion which is narrowed down from the trunk portion to the mouth portion, wherein: the amount of the contents of the plastic container is 800 to 3000 ml; the average thickness of the trunk portion is 0.2 to 0.7 mm; the ratio of a length H of the trunk portion to a length L of a diagonal line of a rectangle formed by the outer periphery of a horizontal cross section of the trunk portion (H/L) is 2 to 4; each of vertexes of the rectangle formed by the outer periphery of the horizontal cross section of the trunk portion forms an arc-shaped configuration so that a radius R of curvature of the vertex is 3 to 20 mm; a removal opening is provided at the inner periphery of the mouth portion and is closed by a seal member which can be punched by one of a pipe-shaped body and a rod-shaped body; and the plastic container is used for the purpose of containing photographic processing chemicals.

As the container for photographic processing chemicals having the removal opening, which is provided at the inner periphery of the mouth portion and is closed by the seal member which can be punched by the pipe-shaped body or the rod-shaped body, it is desirable that the plastic container is elongated, has a certain amount of volume, has high space efficiency, has self-sustainability and configuration maintainability, and is friendly to the environment so that the container can be easily crushed.

Therefore, because the amount of the contents is 800 to 3000 ml, the container for photographic processing chemicals has a volume sufficient to meet all requirements. Since the container is elongated so that the ratio of the length H of the trunk portion to the length L of the diagonal line of the rectangle formed by the outer periphery of the horizontal cross section of the trunk portion (H/L) is 2 to 4 and the trunk portion is substantially rectangular pipe-shaped, high space efficiency is obtained. Because the average thickness of the trunk portion is small, i.e., 0.2 to 0.7 mm, the container is friendly to the environment in that the container can be easily crushed. Since each of the vertexes of the rectangle formed by the outer periphery of the horizontal cross section of the trunk portion forms an arc-shaped configuration so that the radius R of curvature of the vertex is 3 to 20 mm, good self-sustainability and configuration maintainability can be obtained.

A sixth aspect of the present invention is a method of supplying photographic processing chemicals, comprising: a holding step in which a container for photographic processing chemicals, in which the plastic container described in the fifth aspect is filled with photographic processing chemicals, is held above a replenishing tank of an automatic processor so that the removal opening of the container faces downwardly; an opening step in which the seal member of the container for photographic processing chemicals is pressed from below by a pipe-shaped body and the removal opening is opened; and a washing step in which washing water is injected into the container for photographic processing chemicals through the discharge opening formed at the pipe-shaped body and the interior of the container for photographic processing chemicals is washed.

Namely, first, in the holding step, the container for photographic processing chemicals, in which the plastic container of the fifth aspect of the present invention is filled with photographic processing chemicals, is held above the automatic processor so that the removal opening faces downwardly. At this time, the removal opening opposes the replenishing tank. The seal member for the removal opening is, for example, a thin film formed from aluminum, plastic, or the like. This seal member (thin film) is adhered to the edge of the removal opening such that the removal opening of the container for photographic processing chemicals is closed.

Further, the photographic processing chemicals included in the container for photographic processing chemicals may be liquid, paste, or powder.

Next, in the opening step, the seal member is pressed from below by the pipe-shaped body. In this way, the seal member is broken through and the discharge opening provided at the distal end of the pipe-shaped body is disposed within the container for photographic processing chemicals. Further, the photographic processing chemicals flow out from the container for photographic processing chemicals with the removal opening facing downwardly and replenished into the replenishing tank. Because the plastic container of the fifth aspect of the present invention has excellent configuration maintainability, when this is used as the container for photographic processing chemicals, it is difficult for the container to be crushed due to the reduction in the internal pressure thereof when the liquid flows out and, even if the container is crushed to some extent, the configuration thereof recovers due to the configuration maintainability of the container itself.

Next, in the washing step, the washing water is injected into the container for photographic processing chemicals through the discharge opening formed at the pipe-shaped body and the interior of the container for photographic processing chemicals is washed. Since the container for photographic processing chemicals is not deformed due to the crushing in the opening step, the storage of liquid or the like in the deformed portion does not occur and the inner surface of the container can be completely washed.

At this time, when the photographic processing chemicals are liquid, it is possible to wash even a small amount of the photographic processing chemicals adhered onto the inner side of the container for photographic processing chemicals. Further, when the photographic processing chemicals are paste, the photographic processing chemicals are diluted by the washing water and become liquid. Thus, even if the inner diameter of the removal opening is small, the photographic processing chemicals drop smoothly from the container for photographic processing chemicals, and all of the photographic processing chemicals remaining therein can be washed. Moreover, even if the photographic processing chemicals are powder and solidified due to water absorbed thereto, the photographic processing chemicals are dissolved into the washing water and become liquid. Thus, the photographic processing chemicals drop smoothly from the container for photographic processing chemicals, and the photographic processing chemicals remaining therein can be washed out. In this way, whether the photographic processing chemicals are liquid, paste, or powder, the interior of the container for photographic processing chemicals can be washed out and all of the photographic processing chemicals can be made to flow out in the washing step. As a result, after the washing step has been completed, only the washing solution is applied to the inner surface of the container for photographic processing chemicals.

In this way, in the method of supplying photographic processing chemicals of the sixth aspect of the present invention, it is easy to open the removal opening in the opening step by simply pressing the seal member by the pipe-shaped body. Unlike the conventional example, there is no need for an operation to remove a cap every time the photographic processing chemicals are supplied and the processing solutions are not applied to the operator's hands or clothes. At this time, since the container for photographic processing chemicals has excellent self-sustainability, it is difficult for the container to be crushed due to the reduction in the internal pressure thereof when the liquid flows out and, even if the container is crushed to some extent, the configuration thereof recovers due to the configuration maintainability of the container itself.

Further, since the container for photographic processing chemicals is washed in the washing step, whether the photographic processing chemicals are liquid, paste, or powder, all of the photographic processing chemicals can be flowed out from the container. At this time, since the configuration of the container for photographic processing chemicals remains as it is, the storage of liquid or the like in the deformed portion does not occur and the inner surface of the container can be completely washed.

Moreover, because the pipe-shaped body which has pressed the seal member is disposed within the container for photographic processing chemicals, the washing solution can be discharged through the discharge opening which is continuously formed at the pipe-shaped body and operation between the steps is not wasted.

The interior of the container for photographic processing chemicals is washed in this way and dried as occasion demands. The container for photographic processing chemicals can be reused as it is or disposed for recycling.

A seventh aspect of the present invention is a device for supplying photographic processing chemicals, comprising: holding means which holds a container for photographic processing chemicals, being the plastic container of the fifth aspect of the present invention filled with photographic processing chemicals, above a replenishing tank of an automatic processor so that the removal opening of the container faces downwardly; a pipe-shaped body which is provided at the automatic processor so that the pipe-shaped body is able to be raised and lowered, the pipe-shaped body pressing from below the seal member of the container for photographic processing chemicals held by the holding means and opening the removal opening; a discharge opening formed at the pipe-shaped body; and supply means which is provided at the automatic processor and supplies washing water to the pipe-shaped body and discharges the washing water through the discharge opening.

Namely, in the device for supplying photographic processing chemicals, the container for photographic processing chemicals, in which the plastic container of the fifth aspect of the present invention is filled with the photographic processing chemicals, is held by the holding means provided above the automatic processor. At this time, the container for photographic processing chemicals is held so that the removal opening thereof faces downwardly.

The pipe-shaped body provided at the automatic processor is raised. The pipe-shaped body presses the seal member from below and opens the removal opening. For example, when the seal member is a thin film made from aluminum, plastic, or the like and is adhered to the edge of the removal opening, this thin film is penetrated. By simply raising the pipe-shaped body in this way, the removal opening can be easily opened. At this time, the discharge opening formed at the distal end of the pipe-shaped body is disposed within the container for photographic processing chemicals.

Since the container for photographic processing chemicals is held by the holding means with the removal opening facing downwardly, when the removal opening is opened, the photographic processing chemicals within the container flow out. Because the plastic container of the fifth aspect of the present invention has excellent configuration maintainability, when the plastic container is used as the container for photographic processing chemicals, it is difficult for the container to be crushed due to the reduction in the internal pressure thereof when the liquid flows out and, even if the container is crushed to some extent, the configuration thereof recovers due to the configuration maintainability of the container itself.

Next, the washing water is supplied to the pipe-shaped body by the supply means and discharged through the discharge opening. Since the container for photographic processing chemicals is not deformed by the crushing in the opening step, the storage of liquid or the like in the deformed portion does not occur and the inner surface of the container can be completely washed.

At this time, when the photographic processing chemicals are liquid, it is possible to wash even a small amount of the photographic processing chemicals applied to the inner side of the container for photographic processing chemicals. When the photographic processing chemicals are paste, the photographic processing chemicals are diluted by the washing water and become liquid. Thus, even if the inner diameter of the removal opening is small, the photographic processing chemicals drop smoothly from the container for photographic processing chemicals, and all of the photographic processing chemicals remaining therein can be washed. Moreover, even if the photographic processing chemicals are powder and solidified due to water absorbed thereto, the photographic processing chemicals are dissolved into the washing water and become liquid. Thus, the photographic processing chemicals can drop smoothly. In this way, only the washing solution is applied to the inner surface of the container for photographic processing chemicals.

In this way, in the device for supplying photographic processing chemicals of the seventh aspect of the present invention, it is easy to open the removal opening by simply raising the pipe-shaped body to press the seal member. Unlike the conventional example, there is no need for an operation to remove a cap every time the photographic processing chemicals are supplied, and the processing solutions are not applied to the operator's hands or clothes. At this time, since the container for photographic processing chemicals has excellent configuration maintainability, it is difficult for the container to be crushed due to the reduction in the internal pressure thereof when the liquid flows out and, even if the container is crushed to some extent, the configuration thereof recovers due to the configuration maintainability of the container itself.

Further, since the washing water is supplied to the pipe-shaped body and discharged through the discharge opening by the supply means, whether the photographic processing chemicals are liquid, paste, or powder, all of the photographic processing chemicals can be allowed to flow out from the container for photographic processing chemicals. At this time, since the configuration of the container for photographic processing chemicals remains as it is, the storage of liquid or the like in the deformed portion does not occur, and the inner surface of the container can be completely washed.

The interior of the container for photographic processing chemicals which has been washed in this way is dried as occasion demands. The container for photographic processing chemicals can be reused as it is or disposed for recycling.

DESCRIPTION OF THE PREFERRED EMBODIMENTS

Figure 1:
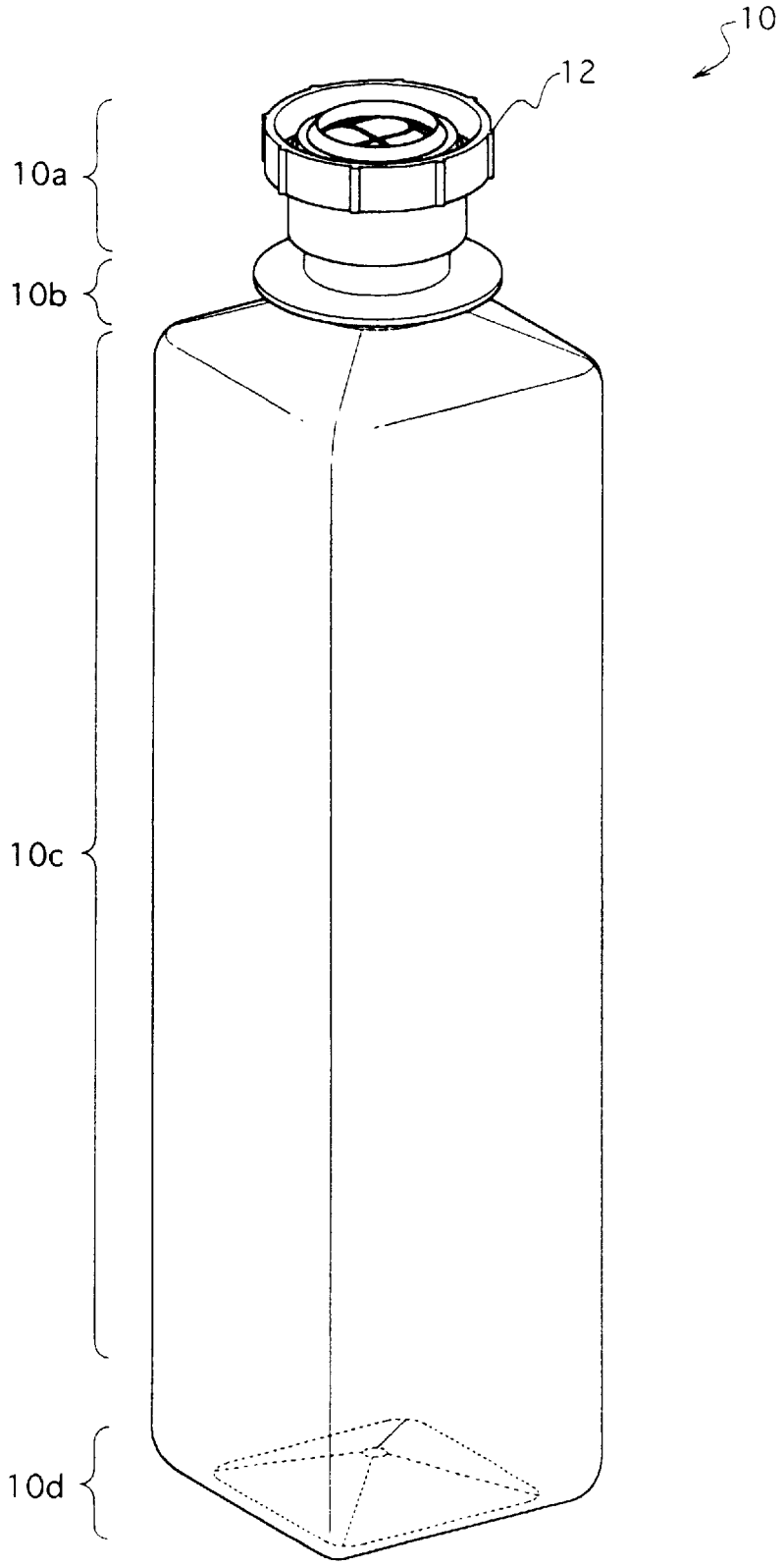
FIG. 1 is a perspective view which shows a plastic container according to a first embodiment of the present invention.

As an example of a plastic container of the present invention, FIG. 1 shows a perspective view of a plastic container 10 according to a first embodiment. Further, FIG. 2 shows a front view of the container 10 for photographic processing chemicals, and FIG. 3 shows a bottom view of the container 10 for photographic processing chemicals.

Figure 2:
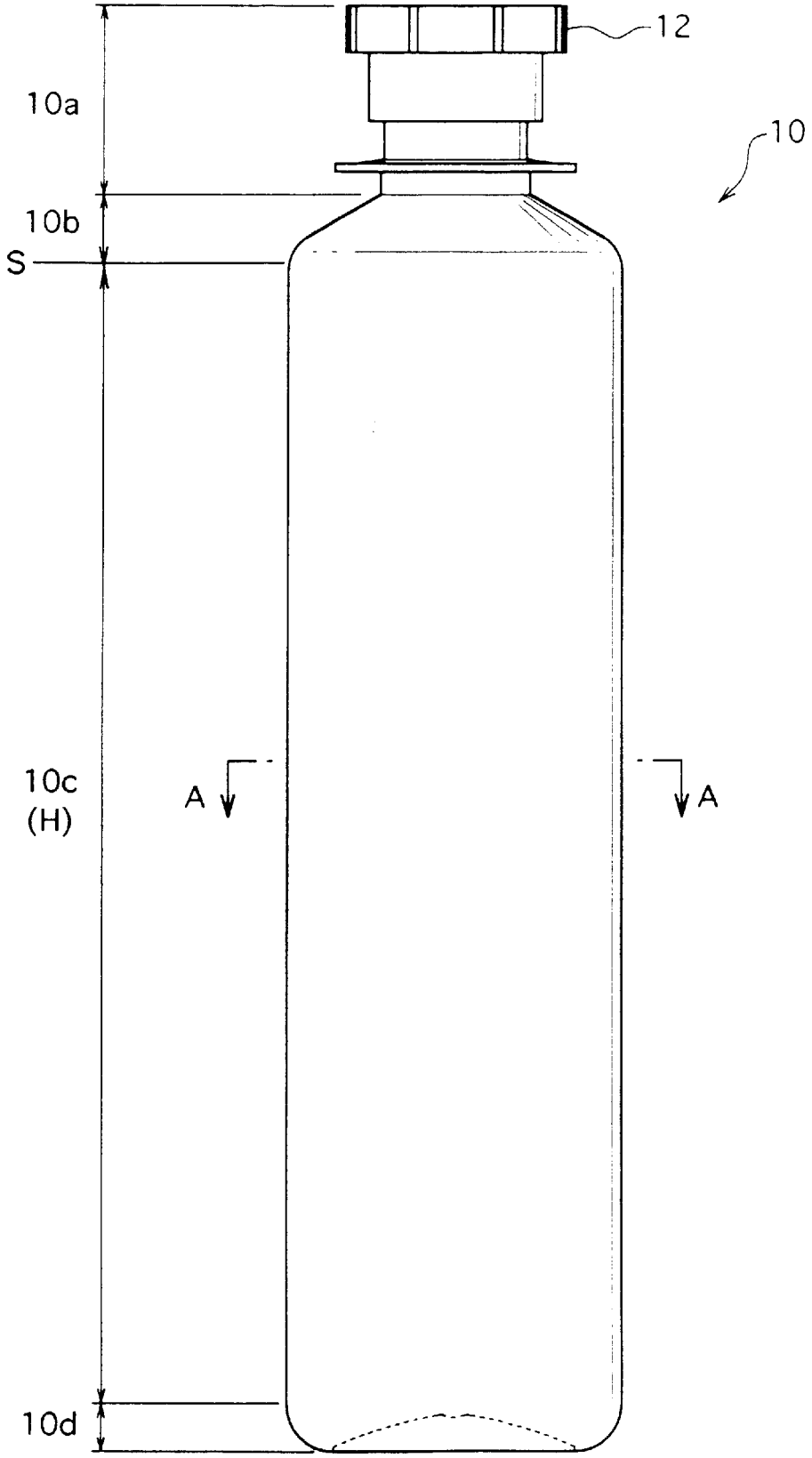
FIG. 2 is a front view which shows the plastic container according to the first embodiment of the present invention.
Figure 3:
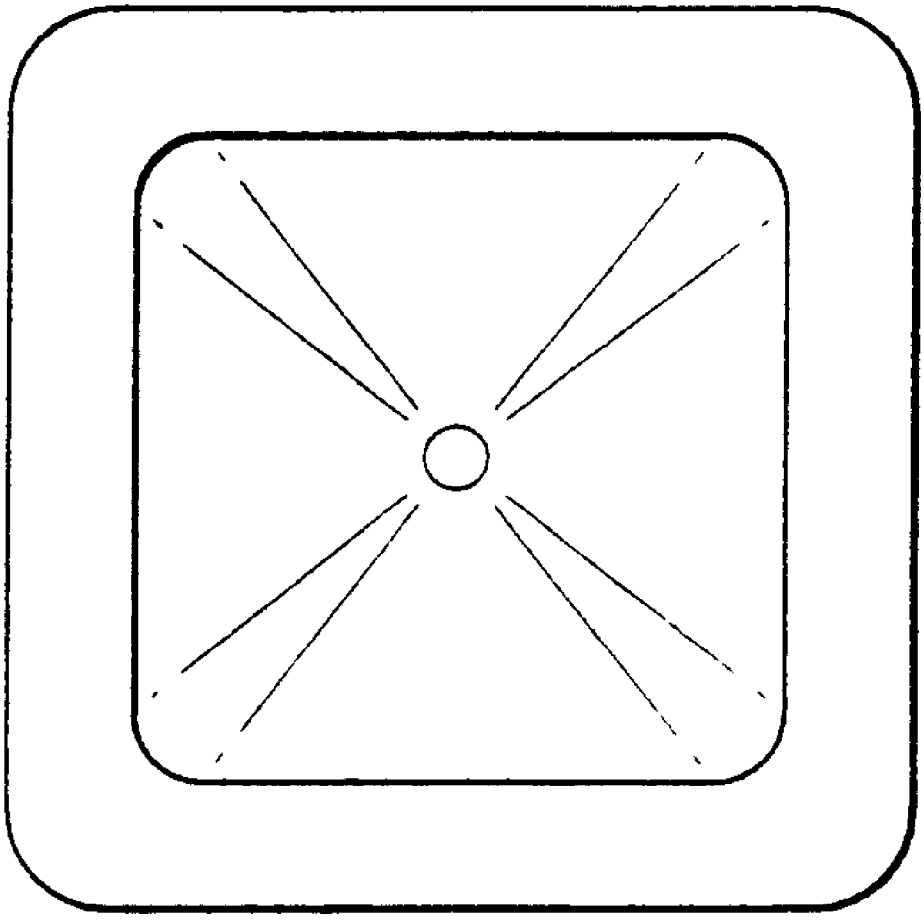
FIG. 3 is a bottom view which shows the plastic container according to the first embodiment of the present invention.

As shown in FIGS. 1 and 2, the plastic container 10 is an elongated bottle-shaped container formed by a bottom portion 10*d*, a trunk portion 10*c*, a mouth portion 10*a*, and a shoulder portion 10*b*. The bottom surface of the bottom portion 10*d* has a substantially rectangular configuration (see FIG. 3). The trunk portion 10*c* has a substantially rectangular pipe-shaped configuration formed by four planes which rise up vertically from respective sides of the bottom surface. The cross-sectional area of a portion of the mouth portion 10*a* surrounded by a horizontal cross section is smaller than that of the trunk portion 10*c*. The shoulder portion 10*b* has a configuration which is narrowed down from the trunk portion 10*c* to the mouth portion 10*a*.

In the present invention, "substantially rectangular" means that a configuration is not completely rectangular, e.g., vertexes are rounded so as to have certain radiuses of curvature or sides are loosely curved, and the configuration on the whole is rectangular.

First, the bottom portion 10*d,* the trunk portion 10*c,* the shoulder portion 10*b,* and the mouth portion 10*a* in the present invention will be defined as follows using FIG. 2.

The trunk portion 10*c* is the range of the plastic container 10 in which, when the plastic container 10 is stood upright as shown in FIG. 2 and filled with contents, the contents mainly exist and is the range in which, when the plastic container 10 is not filled with contents, the horizontal cross section thereof has a certain configuration. The category of "certain configuration" includes minute distortions of the container itself, and slight differences in configuration due to contraction of a resin or the like.

When the plastic container 10 is stood upright as shown in FIG. 2, the bottom portion 10*d* is a portion which is located below the trunk portion 10*c* and closes an opening of the trunk portion 10*c,* and is the range of the plastic container 10 in which the horizontal cross section of the container 10 has different configurations depending on the location.

The shoulder portion 10*b* is a portion having a configuration which is narrowed down from the trunk portion 10*c* to the mouth portion 10*a* and is the range of the plastic container 10 in which the surface area of the horizontal cross section is made smaller toward the mouth portion 10*a*. "Configuration which is narrowed down to the mouth portion 10*a*" is a configuration in which the cross-sectional area of a portion which is surrounded by the horizontal cross section is gradually or rapidly formed smaller from the trunk portion 10*c* to the mouth portion 10*a* and, at the end, the surrounded portion has the same cross-sectional configuration as that of the mouth portion 10*a* and is connected to the mouth portion 10*a* (see "bottle" in JIS Z 0108).

When the plastic container 10 is stood upright as shown in FIG. 2, the mouth portion 10*a* is the entire portion disposed above the shoulder portion 10*b*. When a lid 12 is put on the container 10, the mouth portion 10*a* includes the lid 12.

The amount of the contents of the plastic container 10 is within a range of 800 to 3000 ml. If the amount of the contents is less than 800 ml, there is no reduction of self-sustainability and configuration maintainability of the container or the like. If the amount of contents is more than 3000 ml, it is difficult for the container to obtain self-sustainability and configuration maintainability without increasing the thickness thereof, adding a rib structure thereto, or changing the overall configuration thereof. In the present invention, the amount of the contents is a volume of a liquid or the like which is filled up to a height S of the plastic container 10 in FIG. 2, i.e., from the bottom surface of the bottom portion 10*d* to the upper end of the trunk portion 10*c*.

The average thickness of the trunk portion 10*c* is 0.2 to 0.7 mm and is preferably 0.3 to 0.6 mm. By decreasing the average thickness of the trunk portion 10*c* in this way, it is easy for the plastic container 10 to be crushed and the container 10 is friendly to the environment (has excellent disposability).

Further, the periphery of each of the vertexes of the trunk portion 10*c* can be made thicker than the other portions thereof. As a result, self-sustainability and configuration maintainability of the plastic container 10 can be increased. However, since disposability of the container 10 deteriorates, the thickness of the periphery of each of the vertexes should not be increased excessively. As far as the average thickness is 0.2 to 0.7 mm and the maximum thickness is 0.7 mm or less, it does not matter even if the difference between the thickness of the periphery of each of the vertexes and the thickness of the other portions is large.

Moreover, the average thickness of the bottom portion 10*d* is 0.8 to 5 mm and is more preferably 0.8 to 3 mm. By increasing the average thickness of the bottom portion 10*d* in this way, self-sustainability of the entire container can be increased. If the average thickness is less than 0.8 mm, it is difficult for the plastic container 10 to secure self-sustainability. If the average thickness is more than 5 mm, it is not preferable since disposability of the container is lowered and the material is wasted.

In the same way as in the bottom portion 10*d,* by increasing the average thicknesses of the mouth portion 10*a* and the shoulder portion 10*b,* configuration maintainability of the entire container can be increased. If the thicknesses of the mouth portion 10*a* and the shoulder portion 10*b* are too small, the configuration maintainability of the entire container cannot be maintained. Accordingly, it is desirable that the average thicknesses of the mouth portion 10*a* and the shoulder portion 10*b* are at least larger than the average thickness of the trunk portion 10*c*. Therefore, the preferable ranges of these average thicknesses are the same as the range of the above-described bottom portion 10*d*.

Figure 4A:
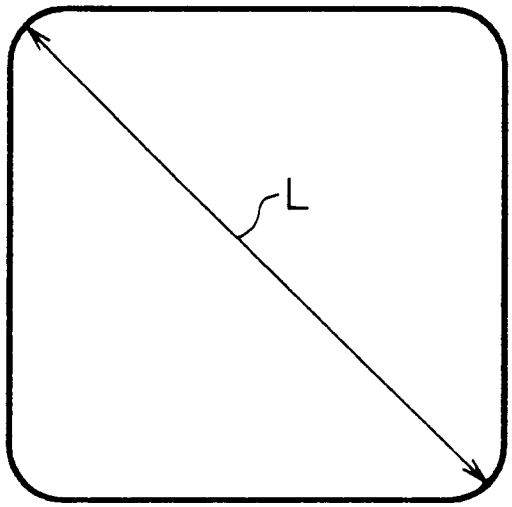
FIG. 4A is a cross-sectional view taken along line A—A in FIG. 2.

FIG. 4A is a cross section taken along line A—A in FIG. 2 (the horizontal cross section of the trunk portion 10*c*). The outer periphery of the horizontal cross section of the trunk portion 10*c* substantially forms a rectangle. Since the trunk portion 10*c* is substantially rectangular pipe-shaped in this way, space efficiency is high.

The ratio of a length H of the trunk portion 10*c* in FIG. 2 to a length L of a diagonal line of the rectangle shown in FIG. 4A (H/L) is within the range of 2 to 4. The plastic container 10 as a whole is elongated.

Figure 4B:
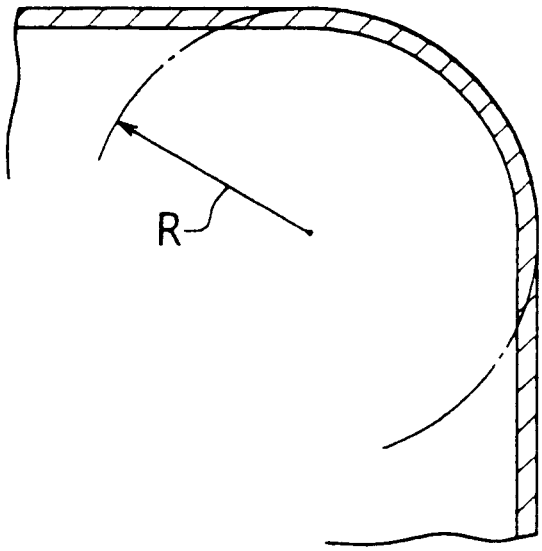
FIG. 4B is an enlarged view of an upper right vertex portion of a rectangle shown in FIG. 4A.

FIG. 4B is an enlarged view of an upper right vertex portion of the rectangle shown in FIG. 4A. Because each of the vertexes of the rectangle formed by the outer periphery of the horizontal cross section of the trunk portion 10*c* is formed arc-shaped, the vertexes serve as ribs provided on the side surfaces of the container and the plastic container 10 can have good self-sustainability and configuration maintainability.

The radius R of curvature of each of the arc-shaped vertexes at this instance is 3 to 20 mm and is preferably 3 to 15 mm. If the radius R of curvature is less than 3, the plastic container 10 cannot have good self-sustainability and configuration maintainability and, when the interior of the plastic container 10 is washed, washability of the vicinity of each of the vertexes lowers. On the other hand, if the radius R of curvature is more than 20 mm, the trunk portion 10*c* is almost cylindrical such that the space efficiency is lowered. Moreover, since the vertex portion serving as a pillar is gone and the configuration maintainability is lowered, it is easy for the container 10 to be crushed due to the reduction in the internal pressure thereof when the contents flow out, and the configuration of the container may be deformed.

Any plastic material can be used for the above-described plastic container 10. For example, polyethylene terephthalate (PET), polyethylene (PE), polypropylene (PP), polyvinyl chloride (PVC), or the like can be used. PET has excellent impact resistance and produces a highly precise molding product through an injection blow molding method which can reduce the thickness and weight of the product. However, PET does not have sufficient chemical resistance and is not particularly suitable for preserving alkali chemicals such as a photographic developer or the like. PP has excellent chemical resistance, however, it has poor impact resistance at low temperatures. Moreover, PVC has excellent chemical resistance, however, since PVC includes chlorine, disposal thereof is a serious problem, and in particular, the generation of dioxine by incinerating the PVC is a social problem.

On the other hand, PE has high chemical resistance, has excellent impact resistance, does not generate harmful gas even if it is incinerated, and is easily recycled as a resource. Thus, PE is widely used nowadays as the material of a bottle. Accordingly, it is preferable that the PE which does not have the above-described drawbacks is used as the material of the plastic container 10. In particular, HDPE is preferable since it has high strength, high barrier property, and excellent moldability in the injection blow molding, which will be described later, as compared to LDPE. On the other hand, the LDPE is preferable since it has high moldability and high impact resistance, and it is easy for the LDPE to be thinned as compared to HDPE.

As mentioned above, the plastic container 10 of the first embodiment has a certain amount of volume, high space efficiency, self-sustainability and configuration maintainability, excellent disposability, and excellent chemical resistance and dimensional accuracy. Therefore, the container 10 is particularly useful as a container which is used for the purpose of containing photographic processing chemicals (container for photographic processing chemicals). The container for photographic processing chemicals has a removal opening at the inner circumference of the mouth portion. The removal opening is closed by a seal member which can be punched by a pipe-shaped body or a rod-shaped body. The photographic processing chemicals include, e.g., a color developer, a black-and-white developer, a bleaching solution, an adjustment solution, a reversal solution, a fixer, a bleach-fixer, a stabilizer, or the like.

The above-described plastic container 10 may have a corrugated cardboard box or a plastic box and may be molded and manufactured integrally with the box.

Further, if a plurality of plastic containers 10 are accommodated within a corrugated cardboard box and loaded into an automatic processor as they are, different types of photographic processing chemicals can be replenished simultaneously, and the operator's labor is greatly reduced.

Thus, when the plastic container 10 is accommodated within the corrugated cardboard box, it is easy for the operator to accommodate the plastic container 10 because of its self-sustainability. Moreover, when the plurality of plastic containers 10 are accommodated within the corrugated cardboard box, there is little dead space between the plastic containers 10 since the plastic container 10 is substantially rectangular pipe-shaped.

Figure 5:
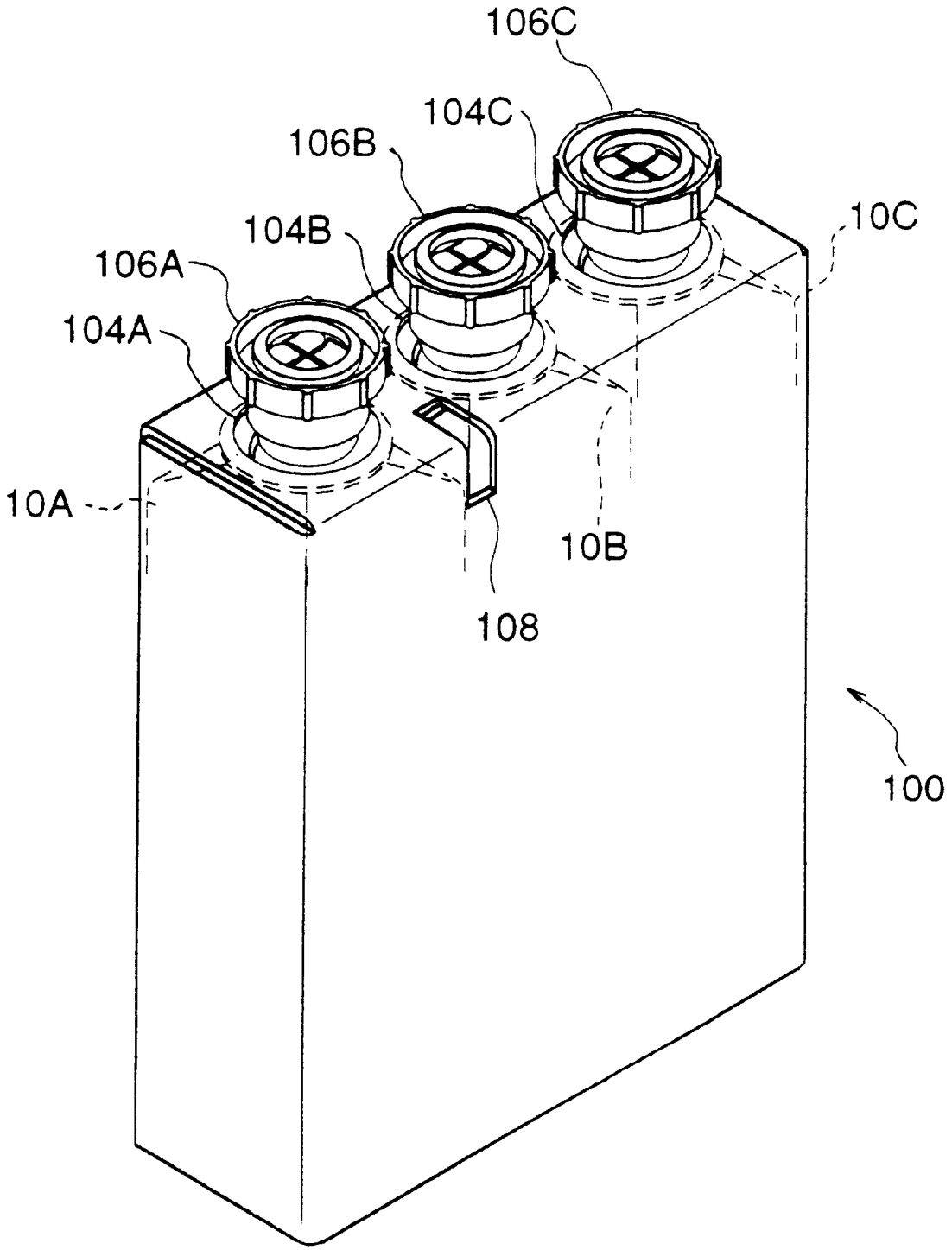
FIG. 5 is a perspective view showing an example of a corrugated cardboard box which contains a plurality of plastic containers.

FIG. 5 shows an example of a corrugated cardboard box in which a plurality of such plastic containers are accommodated. In FIG. 5, a corrugated cardboard box 100 is formed in the shape of a rectangular parallelopiped and the plastic containers 10A, 10B, and 10C having substantially rectangular parallelopiped configurations are accommodated in a row. The plastic containers 10A, 10B, and 10C are respectively filled with photographic processing chemicals for the purpose of developing, bleaching, and fixing. Circular hole portions 104A, 104B, and 104C are provided on the upper surface of the corrugated cardboard box 100. A mouth portion 106A of the plastic container 10A, a mouth portion 106B of the plastic container 10B, and a mouth portion 106C of the plastic container 10C respectively protrude from the hole portions 104A, 104B, and 104C.

Three types of photographic processing chemicals, i.e., developing, bleaching, and fixing can be replenished simultaneously provided that an operator loads the corrugated cardboard box 100 at a predetermined position of an automatic processor (unillustrated) such as a film processor, a printer processor, or the like. Thus, the operator's workload is greatly reduced.

Further, when the corrugated cardboard box 100 is loaded at the predetermined position of the automatic processor in a state in which the mouth portions 106A, 106B, and 106C face downwardly and the mouth portions 106A, 106B, and 106C are opened by a predetermined means which is provided at the automatic processor for opening the mouth portions 106A, 106B, 106C, the operator can replenish the photographic processing chemicals without leaking the photographic processing chemicals by mistake or without sullying hands or clothes. Thus, the operator's workload such as power of attention or the like is reduced.

Moreover, if a notch 108 is provided at an arbitrary position of the corrugated cardboard box 100 other than a central portion in the containers arranging direction and a convex portion (unillustrated), which fits into the notch 108, is provided at a corresponding position of the automatic processor, a risk of replenishing photosensitive processing chemicals at a wrong position of the automatic processor can be avoided.

A method of forming the plastic container 10 of the above-described first embodiment includes a blow molding method such as a direct blow molding method, an injection blow molding method, or the like, and any blow molding method can be used.

In the direct blow molding method, it is relatively easy for the plastic container 10 to be thinned the thickness and lightened. However, if the thickness of the plastic container 10 is reduced too much, the thickness of the entire plastic container 10 is reduced on the principle of molding, and the thicknesses of the mouth portion 10*a* and the shoulder portion 10*b* are also reduced. If the thickness of the mouth portion 10*a* is reduced, it is not preferable since the mouth portion 10*a* does not fit well with the lid 12 and thereby a liquid may be leaked. Also, if the thickness of the shoulder portion 10*b* is reduced, it is not preferable since the configuration maintainability of the entire plastic container 10 is lowered. In the direct blow molding method, the distribution of thickness can be adjusted by the parison control. However, the range of adjustment is small and it is difficult to make the thickness uniform. Accordingly, dimensional accuracy of a molding product of the obtained plastic container 10 may not be sufficient.

On the other hand, the injection blow molding method has the same limits of thinning and lightening as the direct blow molding method. However, because the distribution of thickness can be designed, it is easy to increase the thicknesses of the mouth portion 10*a*, the shoulder portion 10*b*, and the like as compared to that of the trunk portion 10*c*. In accordance with the injection blow molding method, a molding product of the plastic container 10 can be obtained in which liquid does not leak, the self-sustainability and the configuration maintainability are high, and the dimensional accuracy is excellent.

Next, a description will be given of a second embodiment according to a method of and a device for supplying photographic processing chemicals using the plastic container 10 shown in FIGS. 1 through 3.

Figure 6:
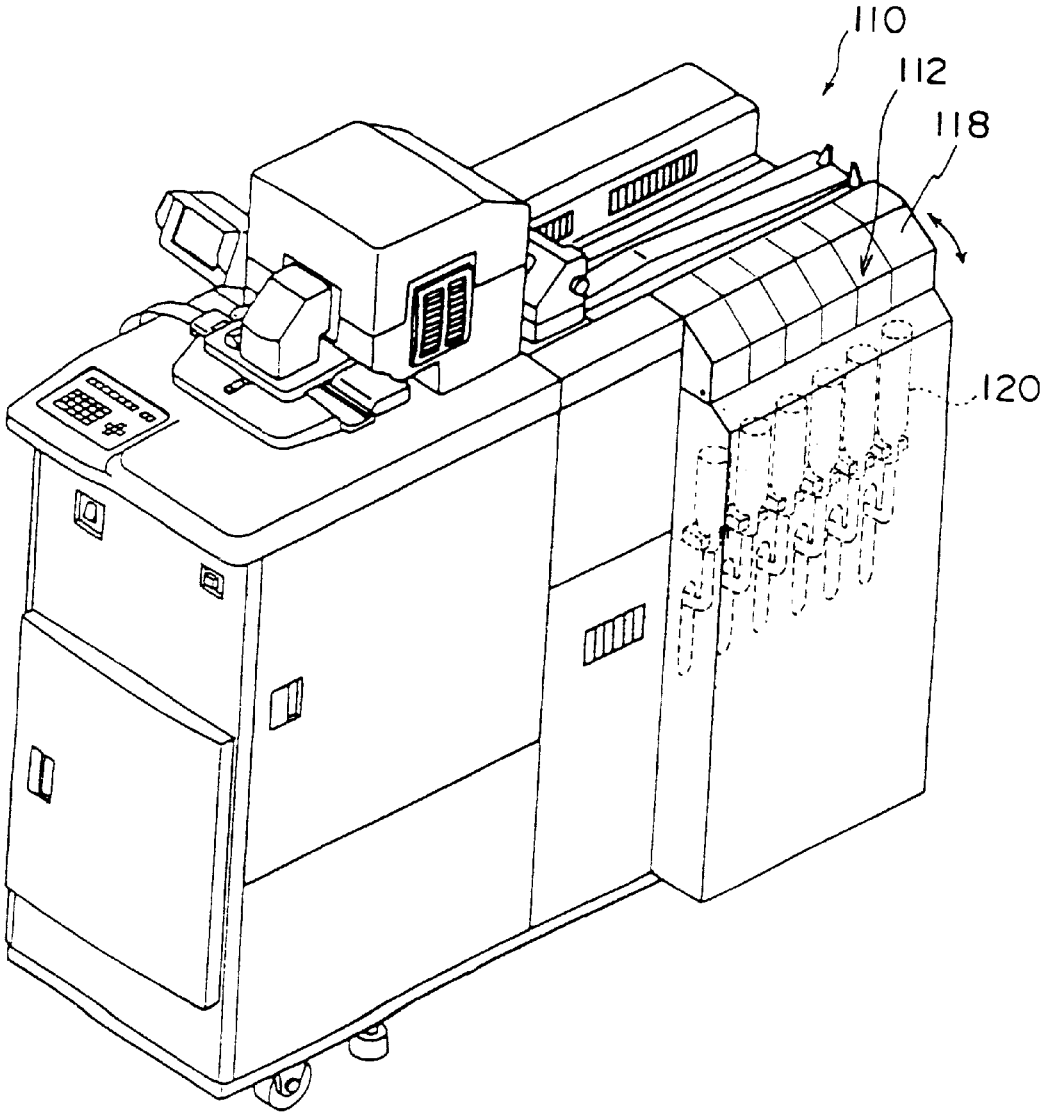
FIG. 6 is a perspective view of an automatic processor which is provided with a device for supplying photographic processing chemicals according to a second embodiment of the present invention.
Figure 7:
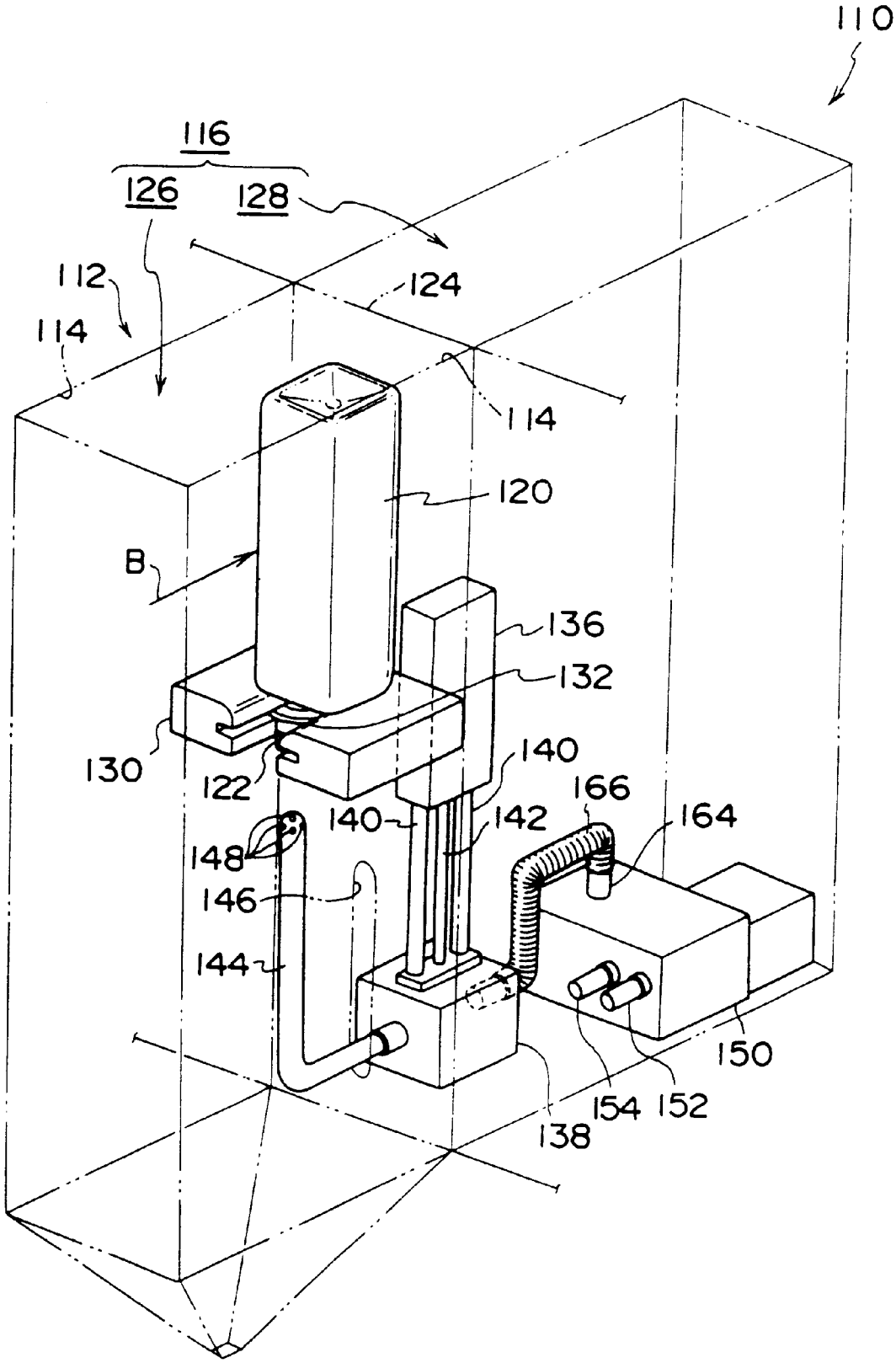
FIG. 7 is a perspective view which shows a scheme of the device for supplying photographic processing chemicals according to the second embodiment of the present invention.

FIG. 6 shows an automatic processor 110 which includes a device 112 for supplying photographic processing chemicals which is the second embodiment of the present invention. As shown in FIG. 7, a plurality of supply chambers 116 are formed in the automatic processor 110 by partitioning walls 114, and the device 112 for supplying photographic processing chemicals is provided at each of these supply chambers 116. Normally, a plurality of devices 112 for supplying photographic processing chemicals are required for each type of photographic processing solutions such as a developer, a fixer, or the like. FIG. 6 shows an example in which six devices 116 for supplying photographic processing chemicals are provided. (In FIG. 6, the partitioning walls 114 are omitted for convenience of illustration.)

Each of the upper portions of the supply chambers 116 can be opened and closed by an opening/closing door 118 which is pivotally supported by the automatic processor 110. The opening/closing door 118 is opened and then a container 120 for photographic processing chemicals can be placed from above into the supply chamber 116.

This container 120 for photographic processing chemicals is the aforementioned plastic container 10 shown in FIGS. 1 through 3. The container 120 for photographic processing chemicals includes liquid-type photographic processing chemicals, and a removal opening 122 of the mouth portion 10*a* for removing the photographic processing chemicals is closed by a seal which is formed from aluminum or plastic in the shape of a thin film.

As shown in FIG. 7, each of the supply chambers 116 is partitioned into a front side supply chamber 126 (the side in the direction opposite the direction of arrow B) and a rear side supply chamber 128 by a partitioning wall 124, and a replenishing tank (unillustrated) is disposed beneath the front side supply chamber 126. A holding plate 130, which is a holding stand, protrudes from a front side of the partitioning wall 124 so that the holding plate 130 is disposed above the replenishing tank. A holding hole 132, whose front side (the side in the direction opposite the direction of arrow B) is opened, is formed at this holding plate 130. When the container 120 for photographic processing chemicals is turned upside down and inserted through this opening of the holding hole 132, a shoulder portion of the container 120 for photographic processing chemicals (the shoulder portion 10*b* of the plastic container 10) abuts the inner surface of the holding hole 132, and the container 120 for photographic processing chemicals is held above the replenishing tank.

A drive portion 136 is fixed to the partitioning wall 124 and disposed within the rear side supply chamber 128. A raising/lowering portion 138 is disposed below this drive portion 136. Two pistons 140 protrude upwardly from the raising/lowering portion 138 and are accommodated within two cylinders (unillustrated) provided within the drive portion 136. The raising/lowering portion 138 is supported by the drive portion 136 so that the raising/lowering portion 138 is able to be raised and lowered. Further, a rack plate 142, at which a rack is formed, protrudes upwardly from the raising/lowering portion 138 and this rack meshes with a pinion (unillustrated) within the drive portion 136. The pinion is rotated due to the driving of a motor (unillustrated) within the drive portion 136 such that the raising/lowering portion 138 can be raised and lowered.

A substantially L-shaped punch pipe 144 protrudes forwardly from the front surface of the raising/lowering portion 138. The punch pipe 144 penetrates through an elongated hole 146 formed at the partitioning wall 124 and the distal end of the punch pipe 144 faces upwardly. The distal end of this punch pipe 144 is disposed below a removal opening 122 of the container 120 for photographic processing chemicals in a state in which the container 120 is loaded into the holding plate 130. The outer diameter of the punch pipe 144 is slightly smaller than the inner diameter of the removal opening 122 so that the photographic processing chemicals flow between the punch pipe 144 and the removal opening 122.

The distal end of the punch pipe 144 is formed in the semi-spherical shape and a plurality of discharge openings 148 are formed at this semi-spherical portion.

A supply portion 150 is disposed further toward a rear side of the rear side supply chamber 128 than the drive portion 136 and the raising/lowering portion 138. A washing water pipe 152 and a drying air pipe 154 penetrate through a front wall of this supply portion 150. Substantially intermediate portions of the washing water pipe 152 and the drying air pipe 154 are divided in the supply portion 150. A through-hole communicates with one of the washing water pipe 152 and the drying air pipe 154 and blocks the other by a valve (unillustrated).

The washing water pipe 152 and the drying air pipe 154 are integrated into an aggregated pipe 164 within the supply portion 150 and the aggregated pipe 164 protrudes upwardly from the upper surface of the supply portion 150. The aggregated pipe 164 is connected to the raising/lowering portion 138 via a flexible pipe 166 and is further connected to the punch pipe 144 through the raising/lowering portion 138.

Further, the washing water pipe 152 communicates with a washing water tank provided within the automatic processor 110 and washing water within the washing water tank is supplied by a bellows pump.

On the other hand, the drying air pipe 154 communicates with an air collecting device provided within the automatic processor 110, and warm discharged air within the automatic processor 110, which has been collected by this air collecting device, is supplied to the drying air pipe 154 by a fan. Namely, a heating means such as a heater or the like for maintaining the processing solution at a predetermined temperature is provided within the automatic processor 110, and conventionally, heat around this heating means is discharged as warm discharged air to the exterior of the automatic processor 110 by a fan or the like. This warm discharged air within the automatic processor 110, which has conventionally been discharged to the exterior, is collected by the air collecting device and supplied to the drying air pipe 154 by the fan.

Next, a method of supplying a liquid-type photographic processing chemicals accommodated within the container 120 for photographic processing chemicals will be explained using the device 112 for supplying photographic processing chemicals of the second embodiment.

First, the opening/closing door 118 is opened and, as shown in FIG. 7, the container 120 for photographic processing chemicals is inserted through the holding hole 132 of the holding plate 130 and is then loaded. In this state, the container 120 for photographic processing chemicals is held above the replenishing tank (unillustrated) so that the removal opening 122 faces downwardly.

Next, a control device rotates the pinion within the drive portion 136 and raises the raising/lowering portion 138. In this way, the punch pipe 144 is also raised, and the distal end of the punch pipe 144 penetrates a thin film seal which is made from aluminum or plastic and closes the removal opening 122. The removal opening 122 is thereby opened. There is a space between the removal opening 122 and the punch pipe 144, and the photographic processing chemicals flow through this space and are replenished into the replenishing tank. At this time, the discharge opening 148 provided at the distal end of the punch pipe 144 is disposed within the container 120 for photographic processing chemicals. Because the container 120 for photographic processing chemicals which is the plastic container 10 has excellent configuration maintainability, it is difficult for the container 120 to be crushed due to the reduction in the internal pressure thereof when the liquid flows out and, even if the container 120 is crushed to some extent, the configuration thereof recovers due to the configuration maintainability of the container 120 itself.

When the flowing-out of the photographic processing chemicals is finished, the valve is driven so as to close the drying air pipe 154 and communicate with the washing water pipe 152. The washing water within the washing water tank is discharged by a predetermined means through the discharge opening 148 via the washing water pipe 152, the aggregated pipe 164, the flexible pipe 166, and the punch pipe 144. In this way, all of the photographic processing chemicals applied to the inner surface of the container 120 for photographic processing chemicals is washed out by the washing water and the container 120 for photographic processing chemicals is washed. Since the container 120 for photographic processing chemicals is not deformed by the crushing in the opening process, the storage of solution or the like in the deformed portion does not occur and the inner surface of the container 120 can be completely washed.

Next, the valve is driven so as to communicate with the drying air pipe 154 and close the washing water pipe 152. When the fan is operated, warm discharged air within the automatic processor 110 is discharged from the discharge opening 148 through the drying air pipe 154, the aggregated pipe 164, the flexible pipe 166, and the punch pipe 144. In this way, all of the washing solutions applied to the inner surface of the container 120 for photographic processing chemicals are evaporated and the container 120 for photographic processing chemicals is dried.

Next, the motor within the drive portion 136 is reversely rotated so as to lower the punch pipe 144 and the container 120 for photographic processing chemicals is removed from the holding plate 130. Since there is nothing left in the container 120 for photographic processing chemicals, the container 120 can be reused as it is or disposed for recycling.

The replenishing tank is replenished with washing water and photographic processing chemicals of the container 120 for photographic processing chemicals. In order to obtain the photographic processing chemicals having a desirable concentration, water is further replenished into the replenishing tank.

A description is given of a case in which the photographic processing chemicals are liquid. However, even if the photographic processing chemicals are paste or powder, the photographic processing chemicals can be replenished and the container 120 for photographic processing chemicals can be washed and dried in the same manner as described above. When the photographic processing chemicals are paste, the paste-type photographic processing chemicals can be diluted by the washing water and become liquid and flowed out through the removal opening 122. Consequently, the photographic processing chemicals are not left in the container 120 for photographic processing chemicals. Moreover, even when the photographic processing chemicals are powdery and solidified by absorbing water within the container 120 for photographic processing chemicals, the solidified photographic processing chemicals can be dissolved by washing water and flowed out as liquid through the removal opening 122. Accordingly, the photographic processing chemicals are not left in the container 120 for photographic processing chemicals.

As described above, in accordance with the device 112 for supplying photographic processing chemicals of the second embodiment, the removal opening 122 can be opened and the photographic processing chemicals can be allowed to flow out by simply raising the punch pipe 144. At this time, since the container for photographic processing chemicals has excellent configuration maintainability, it is difficult for the container to be crushed due to the reduction in the internal pressure thereof when the liquid flows out and, even if the container is crushed to some extent, the configuration thereof recovers due to the configuration maintainability of the container itself.

Further, since the washing water is discharged through the discharge opening 148 of the punch pipe 144 and the photographic processing chemicals within the container 120 for photographic processing chemicals are washed out, the photographic processing chemicals are not left in the container 120 and wasted. At this time, because the configuration of the container for photographic processing chemicals is maintained as it is, the storage of liquid or the like in the deformed portion does not occur and the inner surface of the container can be completely washed.

Furthermore, because the warm discharged air is discharged through the discharge opening 148 of the punch pipe 144 in such a way that the washing water remaining in the container 120 for photographic processing chemicals is evaporated and the container 120 is dried, the container 120 can be reused as it is or disposed for recycling.

Also, since the ventilatiny discharged air within the automatic developer 10 is reused as the above-mentioned warm discharged air, the energy is not wasted and the container 120 for photographic processing chemicals can be dried in a short time.

In the second embodiment, a description is given of the method of supplying photographic processing chemicals (the device for supplying photographic processing chemicals) which includes the drying process (means), in which drying air is discharged into the container 120 for photographic processing chemicals and dries the interior thereof. However, the washing process(means) may take place (may be provided) without the drying process (means), and the container 120 for photographic processing chemicals is removed as it is and can be reused or recycled.

In accordance with the present invention, by having a specific configuration, the plastic container can be provided which has a certain amount of volume, has high space efficiency, has self-sustainability and configuration maintainability, and is friendly to the environment in that it is easy for the container to be crushed.

Further, by using appropriate materials and a molding method, the plastic container can be provided which has excellent chemical resistance and dimensional accuracy and, in particular, which is useful as a container for photographic processing chemicals.

Still further, by using a plastic container having the above-described characteristics as the container for photographic processing chemicals, the device for and the method of supplying photographic processing chemicals can be provided in which the interior of the container is washed efficiently and the container for photographic processing chemicals can be reused as it is or disposed for recycling.

What is claimed is:

1. A plastic container, comprising:

a bottom portion which has a substantially rectangular bottom surface;

a trunk portion which is formed by four flat planar sides which rise up vertically from respective sides of the bottom surface and which is substantially rectangular pipe-shaped;

a mouth portion whose surface area of a portion surrounded by a horizontal cross-section is smaller than the surface area of said trunk portion; and a shoulder portion which is narrowed down from said trunk portion to said mouth portion;

wherein:

the amount of the contents of said plastic container is 800 to 3000 ml;

the average thickness of said trunk portion is 0.2 to 0.7 mm;

the ratio of a length H of said trunk portion to a length L of a diagonal line of a rectangle formed by outer periphery of a horizontal cross section of said trunk portion (H/L) is 2 to 4; and each of the vertexes of the rectangle formed by the outer periphery of the horizontal cross-section of said trunk portion forms an arc-shaped configuration so that a radius R of curvature of the vertex is 3 to 20 mm.

2. A plastic container according to claim 1, wherein said plastic container is formed from HDPE.

3. A plastic container according to claim 2, wherein the average thickness of said bottom portion is 0.8 to 5 mm.

4. A plastic container according to claim 3, wherein said plastic container is molded in accordance with an injection blow molding method.

5. A plastic container according to claim 1, wherein said plastic container is formed from LDPE.

6. A plastic container according to claim 5, wherein the average thickness of said bottom portion is 0.8 to 5 mm.

7. A plastic container according to claim 6, wherein said plastic container is molded in accordance with an injection blow molding method.

8. A plastic container according to claim 1, wherein the average thickness of said bottom portion is 0.8 to 5 mm.

9. A plastic container according to claim 8, wherein said plastic container is molded in accordance with an injection blow molding method.

10. A plastic container according to claim 1, wherein said plastic container is molded in accordance with an injection blow molding method.

11. A plastic container according to claim 1, wherein said plastic container is accommodated within a box whose inner surface has a length and width wherein the number of plastic containers that can be tightly packed therein is a multiple of an integer.

12. A plastic container for containing photographic processing chemicals, comprising:

a bottom portion which has a substantially rectangular bottom surface;

a trunk portion which is formed by four side surfaces formed by flat planes which rise up vertically from respective sides of the bottom surface and which is substantially rectangular pipe-shaped;

a mouth portion whose surface area of a portion surrounded by a horizontal cross section is smaller than the surface area of said trunk portion; and a shoulder portion which is narrowed down from said trunk portion to said mouth portion, wherein:

the amount of the contents of said plastic container is 800 to 3000 ml;

the average thickness of said trunk portion is 0.2 to 0.7 mm;

the ratio of a length H of said trunk portion to a length L of a diagonal line of a rectangle formed by the outer periphery of a horizontal cross section of said trunk portion (H/L) is 2 to 4;

each of the vertexes of the rectangle formed by the outer periphery of the horizontal cross section of said trunk portion forms an arc-shaped configuration so that a radius R of curvature of the vertex is 3 to 20 mm; and a removal opening is provided at the inner periphery of said mouth portion and is closed by a seal member which can be punched by one of a pipe-shaped body and a rod-shaped body.

13. A plastic container according to claim 12, wherein the average thickness of said trunk portion being 0.2 to 0.7 mm promotes achieving a desired crushability characteristic of said container, the ratio (H/L) being 2 to 4 and the radius R of curvature of the vertex being 3 to 20 mm promotes achieving a desired space efficiency characteristic of said container, and the amount of the contents of said plastic container being 800 to 3000 ml and the radius R of curvature of the vertex being 3 to 20 mm promotes achieving a desired self-sustainability of said container.

14. A plastic container, comprising:

a bottom portion which has a substantially rectangular bottom surface;

a trunk portion which is formed by four flat planar sides which rise up vertically from respective sides of the bottom surface and which is substantially rectangular pipe-shaped;

a mouth portion whose surface area of a portion surrounded by a horizontal cross section is smaller than the surface area of said trunk portion; and a shoulder portion which is narrowed down from said trunk portion to said mouth portion, wherein:

the amount of the contents of said plastic container is 800 to 3000 ml;

the average thickness of said trunk portion is 0.2 to 0.7 mm;

the ratio of a length H of said trunk portion to length L of a diagonal line of a rectangle formed by the outer periphery of a horizontal cross section of said trunk portion (H/L) is 2 to 4;

each of the vertexes of the rectangle formed by the outer periphery of the horizontal cross section of said trunk portion forms an arc-shaped configuration so that a radius R of curvature of the vertex is 3 to 20 mm; and a removal opening is provided at the inner periphery of said mouth portion and is closed by a seal member which can be punched by one of a pipe-shaped body and a rod-shaped body, a method of supplying photographic processing chemicals which uses said plastic container, comprising the steps of:

holding said container for photographic processing chemicals filled with photographic processing chemicals above a replenishing tank of an automatic processor so that the removal opening of the container faces downwardly; and opening the seal member of said container for photographic processing chemicals by pressing from below by a pipe-shaped body and opening said removal opening.

15. A method of supplying photographic processing chemicals according to claim 14, further comprising the step of:

washing the interior of said container for photographic processing chemicals by discharging washing water into said container for photographic processing chemicals through a discharge opening formed at said pipe-shaped body.

16. A method of supplying photographic processing chemicals according to claim 14, wherein said removal opening of the plastic container is loaded into the automatic processor in a state in which said removal opening protrudes from an opening portion of a box containing said plastic container.

17. A method of supplying photographic processing chemicals according to claim 16, wherein a notch is provided at one of the upper edge portion and the lower edge portion of said box other than a longitudinal direction central axis on the front surface in the inserting direction of said plastic container.

18. A method of supplying photographic processing chemicals according to claim 16, wherein a notch is provided at the side edge portion of said box in the inserting direction of said plastic container.

19. A method of supplying photographic processing chemicals according to claim 16, wherein said box is formed from one of corrugated cardboard and plastic.

20. A method of supplying photographic processing chemicals according to claim 16, wherein said plastic container is molded integrally with said box.

21. A plastic container, comprising:

a bottom portion which has a substantially rectangular bottom surface;

a trunk portion which is formed by four side surfaces formed by flat planes which rise up vertically from respective sides of the bottom surface and which is substantially rectangular pipe-shaped;

a mouth portion whose surface area of a portion surrounded by a horizontal cross section is smaller than the surface area of said trunk portion; and a shoulder portion which is narrowed down from said trunk portion to said mouth portion;

wherein:

the amount of the contents of said plastic container is 800 to 3000 ml;

the average thickness of said trunk portion is 0.2 to 0.7 mm;

the ratio of a length H of said trunk portion to a length L of a diagonal line of a rectangle formed by the outer periphery of a horizontal cross section of said trunk portion (H/L) is 2 to 4;

each of the vertexes of the rectangle formed by the outer periphery of the horizontal cross section of said trunk portion forms an arc-shaped configuration so that a radius R of curvature of the vertex is 3 to 20 mm; and a removal opening is provided at the inner periphery of said mouth portion and is closed by a seal member which can be punched by one of a pipe-shaped body and a rod-shaped body, a device for supplying photographic processing chemicals which supplies photographic processing chemicals to an automatic processor using said container for photographic processing chemicals, comprising:

holding means which holds a container for photographic processing chemicals filled with photographic processing chemicals above a replenishing tank of an automatic processor so that the removal opening of the container faces downwardly;

a pipe-shaped body which is provided at said automatic processor so that said pipe-shaped body is able to be raised and lowered, said pipe-shaped body pressing from below the seal member of said container for photographic processing chemicals held by said holding means and opening said removal opening;

a discharge opening formed at said pipe-shaped body; and supply means which is provided at said automatic processor and supplies washing water to said pipe-shaped body and discharges the washing water through said discharge opening.

22. A plastic container according to claim 21, wherein the average thickness of said trunk portion being 0.2 to 0.7 mm promotes achieving a desired crushability characteristic of said container, the ratio (H/L) being 2 to 4 and the radius R of curvature of the vertex being 3 to 20 mm promotes achieving a desired space efficiency characteristic of said container, and the amount of the contents of said plastic container being 800 to 3000 ml and the radius R of curvature of the vertex being 3 to 20 mm promotes achieving a desired self-sustainability of said container.

23. A plastic container according to claim 14, wherein the average thickness of said trunk portion being 0.2 to 0.7 mm promotes achieving a desired crushability characteristic of said container, the ratio (H/L) being 2 to 4 and the radius R of curvature of the vertex being 3 to 20 mm promotes achieving a desired space efficiency characteristic of said container, and the amount of the contents of said plastic container being 800 to 3000 ml and the radius R of curvature of the vertex being 3 to 20 mm promotes achieving a desired self-sustainability of said container.

24. A plastic container according to claim 1, wherein the average thickness of said trunk portion being 0.2 to 0.7 mm promotes achieving a desired crushability characteristic of said container, the ratio (H/L) being 2 to 4 and the radius R of curvature of the vertex being 3 to 20 mm promotes achieving a desired space efficiency characteristic of said container, and the amount of the contents of said plastic container being 800 to 3000 ml and the radius R of curvature of the vertex being 3 to 20 mm promotes achieving a desired self-sustainability of said container.

* * * * *